US006456802B1

(12) United States Patent
Phillips

(10) Patent No.: US 6,456,802 B1
(45) Date of Patent: Sep. 24, 2002

(54) CAPACITY DETERMINATION FOR TONER OR INK CARTRIDGE

(75) Inventor: Quintin T. Phillips, Boise, ID (US)

(73) Assignee: Hewlett-Packard Co., Palo Alto, CA (US)

( * ) Notice: Subject to any disclaimer, the term of this patent is extended or adjusted under 35 U.S.C. 154(b) by 0 days.

(21) Appl. No.: 09/824,892

(22) Filed: Apr. 2, 2001

(51) Int. Cl.[7] ..... G03G 15/08
(52) U.S. Cl. ..... 399/27; 347/7
(58) Field of Search ..... 399/27, 29, 61; 347/7, 19; 118/694

(56) References Cited

U.S. PATENT DOCUMENTS 5,349,377 A 9/1994 Gilliland et al.
5,532,791 A 7/1996 Takahashi et al.
5,655,174 A 8/1997 Hirst ..... 399/27
5,758,224 A 5/1998 Binder et al. ..... 399/25
5,794,094 A 8/1998 Boockholdt et al. ..... 399/27
5,802,420 A * 9/1998 Garr et al. ..... 399/27
5,815,768 A 9/1998 Clifton ..... 399/27
5,937,225 A * 8/1999 Samuels ..... 399/27
6,154,619 A 11/2000 Boockholdt et al. ..... 399/24

* cited by examiner

*Primary Examiner*—William J. Royer

(57) ABSTRACT

Pixel counting and a single level toner sensor are used to identify the toner capacity of a toner cartridge. Pixel counting is used to estimate the remaining toner in a toner cartridge based on an assumed initial capacity. A toner sensor provides a signal indicating when the toner reaches a known level, e.g., 30 percent. The estimated remaining toner is compared to the known level of toner to determine if the assumed initial capacity was correct. The comparison may occur when the toner sensor signal is provided or if the estimated remaining toner falls below the predicted toner low signal level and a toner sensor signal is not provided. If the assumed initial capacity is incorrect, the difference between the estimated toner level and the known level is used to indicate the actual toner capacity of the toner cartridge. A look-up table can then be used to recalibrate the pixel counting so that an accurate estimate of the remaining toner may be performed for the remainder of the toner cartridge life. The present invention may also be used to determine the capacity of other printing mediums, such as ink in an ink cartridge.

22 Claims, 3 Drawing Sheets

CAPACITY DETERMINATION FOR TONER OR INK CARTRIDGE

FIELD OF THE INVENTION

The present invention relates in general to imaging apparatus and, in particular, to monitoring the status of a consumable product, such as a printing medium cartridge, e.g., a toner cartridge for a laser printer or ink cartridge for an ink jet printer, and to identify the capacity of the consumable product.

BACKGROUND

Many image forming apparatus, such as laser printers, copy machines, and facsimile machines, utilize well known electrophotographic printing processes. These image forming apparatus use toner, or the "ink" of the imaging process, to print or copy the desired image or words onto a piece of paper or media.

A disposable toner cartridge is often used in imaging systems, such as laser printers, and is conventionally identified as a "consumable" or "consumable product" because of its limited "life" (i.e., the toner will eventually deplete or some other component will eventually wear out). The toner cartridge may include a toner reservoir, seal assembly, mounting member, development roller assembly, photoconductive drum assembly and charging corona or roller assembly. These items and other similar components are also commonly identified as consumables because they too have a limited life. The toner is contained in the toner reservoir, and is eventually depleted after a certain number of printing processes. Toner cartridges are available with different toner capacities, e.g., the toner may be depleted after printing approximately 2000 pages or 4000 pages.

Certain imaging systems (for example, certain laser printers) are designed to detect when the toner level nears depletion and are capable of displaying a status message such as "toner low" on a display panel. Low cost laser printers, however, cannot afford the expense of a continuous toner level sensor. Thus, printers use pixel counting to estimate the amount of toner remaining in a toner cartridge. However, the initial capacity of the toner cartridge must first be known if pixel counting is to provide a meaningful estimate of the remaining toner. Unfortunately, with the availability of different capacity toner cartridges, the initial capacity of a toner cartridge loaded into a printer is not necessarily recognized by the printer.

One possible solution to the problem posed by the unknown initial capacity of a toner cartridge is to require the user to identify the toner cartridge capacity during loading. However, if the user fails to identify or incorrectly identifies the capacity of the toner cartridge, the toner level pixel count is rendered inaccurate. Another solution is to use an electronic label in the toner cartridge that could inform the printer of the toner cartridge's capacity. An electronic label, however, adds expense to the product.

Accordingly, there exists a need for a printer to inexpensively and reliably identify the capacity of a toner cartridge in order to correctly estimate the amount of toner remaining in the toner cartridge.

SUMMARY

The capacity of a printing medium cartridge, such as a toner cartridge or an ink cartridge, can be identified using printed element counting, e.g., pixel counting or drop counting, and a single level printing medium sensor in accordance with the present invention. For example, when a new toner cartridge is loaded into a printing device, the printing device makes an assumption regarding the toner capacity of the toner cartridge. Pixel counting is used to estimate the remaining toner in the toner cartridge based on the assumed initial capacity of the cartridge. A toner sensor provides a signal indicating when the toner reaches a specified or known level of toner, e.g., 30 percent of the toner remains. The estimated remaining toner based on pixel counting is compared to the known level of toner to determine if the assumed initial capacity was correct. The comparison may occur when the toner sensor signal is provided or if the estimated remaining toner falls below the known level, e.g., 30 percent, and a toner sensor signal is not provided indicating that there is more than 30 percent of toner remaining in the toner cartridge. If the assumed initial capacity is correct, i.e., the estimated remaining toner approximately matches the known level of toner when the toner level signal is provided, the printer continues to estimate the remaining toner based on pixel counting.

If, however, the assumed initial capacity is incorrect, the difference between the estimated toner level and the known level is used to identify the actual toner capacity of the toner cartridge. A look-up table can then be used to recalibrate the pixel counting so that an accurate estimate of the remaining toner may be performed for the remainder of the toner cartridge life based on the actual toner capacity.

The present invention may be used, e.g., to determine the capacity of a toner cartridge used with electrophotographic printing devices or to determine the capacity of an ink cartridge used with ink jet printers.

DETAILED DESCRIPTION

The present invention may be used to determine the capacity of printing medium, such as toner or ink, in a cartridge used, e.g., in electrophotographic printing or ink jet printing. For ease of reference, the present invention will be described with reference to toner capacity of toner cartridges. Nevertheless, it should be understood that the present invention may be used to determine the ink capacity of an ink cartridge in the same manner.

Figure 1:
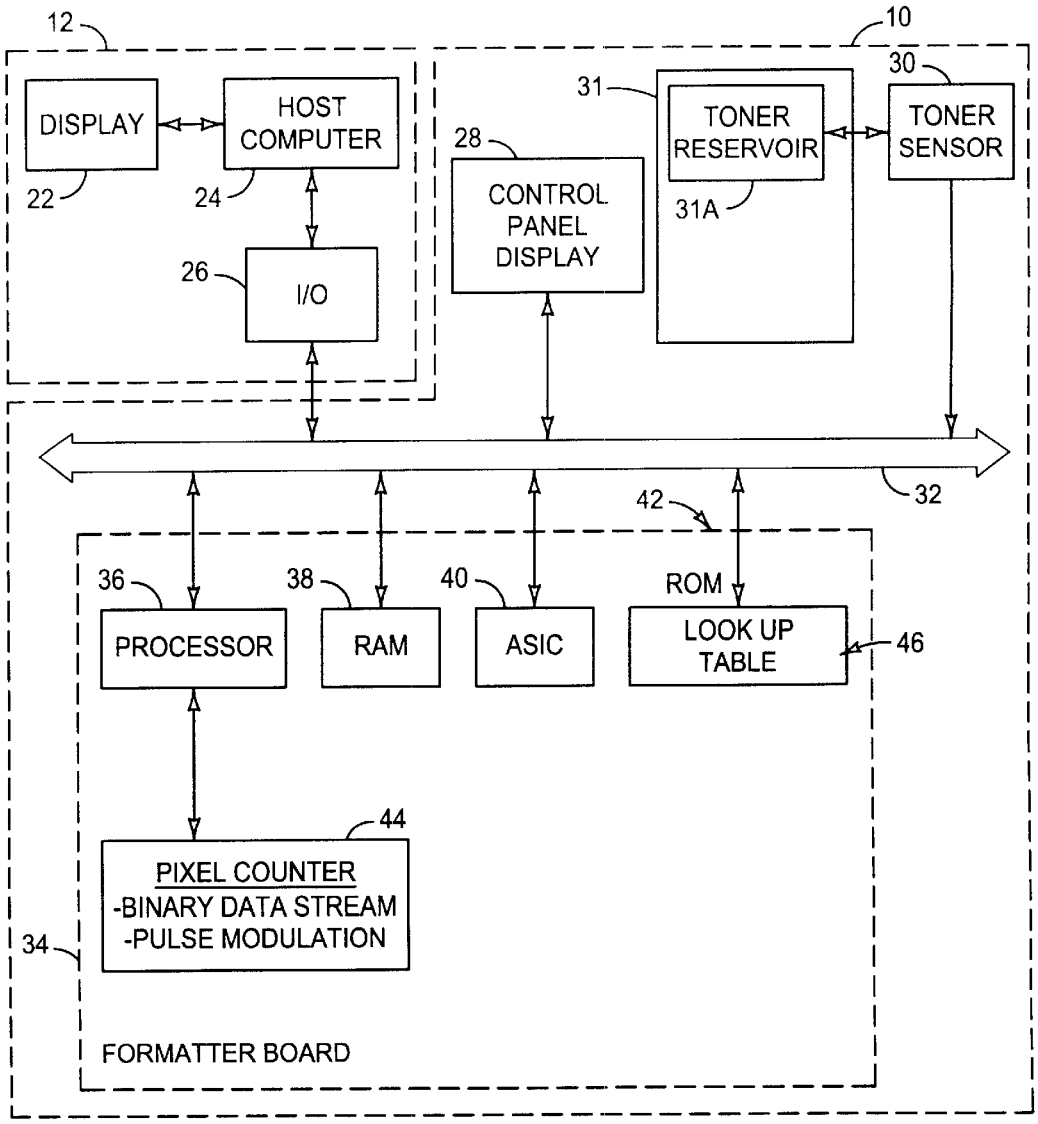
FIG. 1 shows a block diagram of an image-forming apparatus in accordance with the present invention.

FIG. 1 shows a block diagram of an image-forming apparatus in the form of an electrophotographic printing device, or printer, 10 coupled to a computer 12. In one embodiment, the printer 10 is for depositing laser generated images onto a piece of paper. In another configuration, the image-forming apparatus is a plain paper copier or a facsimile machine. Accept as described herein, the general operation of printer 10 may be similar to the printer described in U.S. Pat. No. 5,794,094, which has the same assignee as the present disclosure and is incorporated herein by reference. In accordance with one embodiment of the present invention, a single level toner sensor 30 in conjunction with a pixel counter 44 is used to identify the capacity of the toner cartridge and to correct the weighting factors of the pixel count in a low cost but reliable manner.

As shown in FIG. 1, computer 12 includes a display 22, a host computer 24 including a motherboard having a central processing unit (CPU) and memory, and an input/output (I/O) port 26. Computer 12 connects to printer 10 either directly or via a separate I/O port (not shown) of the printer and a bus 32. Preferably, the I/O connection is made with a cable capable of bidirectional, parallel communication, such as a BiTronics™ cable available from Hewlett-Packard. Bus 32 of printer 10 forms the internal control paths for communicating between devices of printer 10. For example, a control panel display 28, the toner sensor 30, a formatter board 34, and ROM 42 communicate via bus 32. Bus 32 includes a data bus, an address bus, a control bus, and a supply voltage from a power supply (not shown).

Printer 10 includes a printing medium cartridge, e.g., toner cartridge 31, which includes a reservoir 31 A where a supply of powered toner is stored. Printer 10 also includes a printing medium level sensor, e.g. toner sensor 30, that indicates when there is a specific, known level of toner in reservoir 31 A, e.g., 30 percent of the toner remains. The toner cartridge 31 is, e.g., a replaceable toner/developer cartridge that enables a user to quickly and easily replace toner when the cartridge has been emptied. The toner cartridge 31 may have any one of a number of toner capacities. For example, toner cartridge 31 may have a 2000 page or a 4000 page capacity.

Formatter board 34 prepares printer 10 to communicate data with computer 12. Board 34 includes a processor 36, RAM 38, ASIC computer chip 40, ROM 42 and a pixel counter 44.

A printed element counter, e.g., pixel counter 44, is implemented via processor 36 for counting printed elements, e.g., pixels, used to print each page, or sheet of paper, on printer 10. Pixel counter 44 counts the pixels required to print a binary data stream defining each page being printed. Alternatively, pixel counter 44 counts the pixels required to print a mapped page being printed with toner pulse modulation wherein the number of pixels needed to print a feature varies depending on whether one-quarter, one-half, three-quarters, or full pulse modulation is used. A typical toner pulse modulation scheme has eight different degrees of pixel use. It is to be understood that black, white, gray levels and individual colors each form a particular toner hue wherein pixel values associated with the particular hue can be counted by the pixel counter.

The results from pixel counter 44 are used by processor 36 to estimate the amount of toner remaining in the toner cartridge 31. To do this, however, processor 36 must make an initial assumption about the capacity of toner cartridge 31. Then processor 36 can estimate the amount of remaining toner based on the pixel count by pixel counter 44, e.g., the number of pixels printed is converted into an estimated amount of toner and the amount of toner is deducted from the assumed initial capacity of the toner cartridge 31.

ROM 42 is used to store a look-up table 46 containing information relating to pixel count weighting factors to be used when the toner cartridge has a different capacity than initially assumed. Thus, look-up table 46 permits processor 36 to reestimate the amount of toner used per pixel and to correct the total toner remaining estimate based on the weighting factors. ROM 42 may contain other look-up tables, if desired, that contain pixel information for a data stream defining particular print characteristics received from a print job of a computer 12. Optionally, ROM 42 may contain a look-up table that contains information about laser modulation to achieve particular print characteristics, with each printer having its own calibration of toner use. For example, a look-up table can contain laser modulation information defining toner use such as half modulation, quarter modulation, and the like. Additionally, or alternatively, look-up table 46, as well as other desired look-up tables, can be provided on ASIC 40.

In operation, formatter board 34 translates the Printer Control Language (PCL) code, taking the code and splitting it into different data streams. Typically, most of the printer memory is located on formatter board 34. The PCL code formats gray scale levels for a laser printer, via a binary data stream mode, or optionally, via a laser pulse modulation mode. Similarly, the PCL code formats the distribution of colors for a color printer.

As shown in FIG. 1, printer 10 includes a print engine (not shown) which forms the main working assembly. A print job is sent by computer 12 via I/O 26 to printer 10. The print job is sent from computer 12 to printer 10 in the form of a data stream. The data stream defines how many pixels, as well as the location of the pixels, within each page of a document to be printed. Accordingly, this pixel amount and location information is provided in the form of a pixel array that is mapped to each page to be printed. As discussed above, pixel counter 44 counts the number of pixels printed.

Toner sensor 30 is provided for use with a toner cartridge 31 of printer 10 for roughly detecting a single toner level present within toner reservoir 31A. Preferably, toner sensor 30 is an optical sensor that provides a single toner level indicator signal, i.e., a "toner low" signal, when the toner reaches a specific known level, e.g., approximately 30 percent of the toner remains. Of course, the toner sensor may provide a signal at other specific levels of remaining toner, e.g., from 20 to 40 percent.

Toner sensor 30, for example, is formed by an emitter and a detector that measures a single level of toner present within toner reservoir 31A. According to one construction, a reflective element is supported within the toner reservoir 3 1A, adjacent a viewing window. A light source, or emitter, is provided outside of the toner cartridge 31 and within a cavity in the printer 10 that receives the toner cartridge 31, alongside the cartridge viewing window. Additionally, a detector is provided adjacent to the emitter. Light passes from the emitter, through the window, and reflects off the reflective element in the toner reservoir 31A. Reflected light then passes out the window to be detected by the associated detector, wherein the lack of a detected reflection indicates the presence of toner within the cartridge reservoir 31A at that particular level since it obstructs the reflector. In this manner, toner can be detected at the desired elevational location within toner reservoir 31. When the light from the emitter is detected, the toner level within the toner reservoir is known. Optionally, a pair of windows can be provided in a toner cartridge, one at each end, with the elevationally positioned emitter supported outside the cartridge at one end, and an associated detector positioned elevationally outside the other end of the cartridge.

In accordance with another embodiment of the present invention, the toner sensor 30 may be provided completely within toner reservoir 31. For example, toner sensor 30 can be formed from a wire sensor at the desired elevational position within toner reservoir 31 for sensing the presence of toner at that level. The toner sensor 30 may be a capacitive sensor that can be used to approximately detect toner level remaining available for use by a printer, or may be a fuse sensor, such as that described in U.S. Pat. No. 5,815,768, which is incorporated herein by reference.

Figure 2:
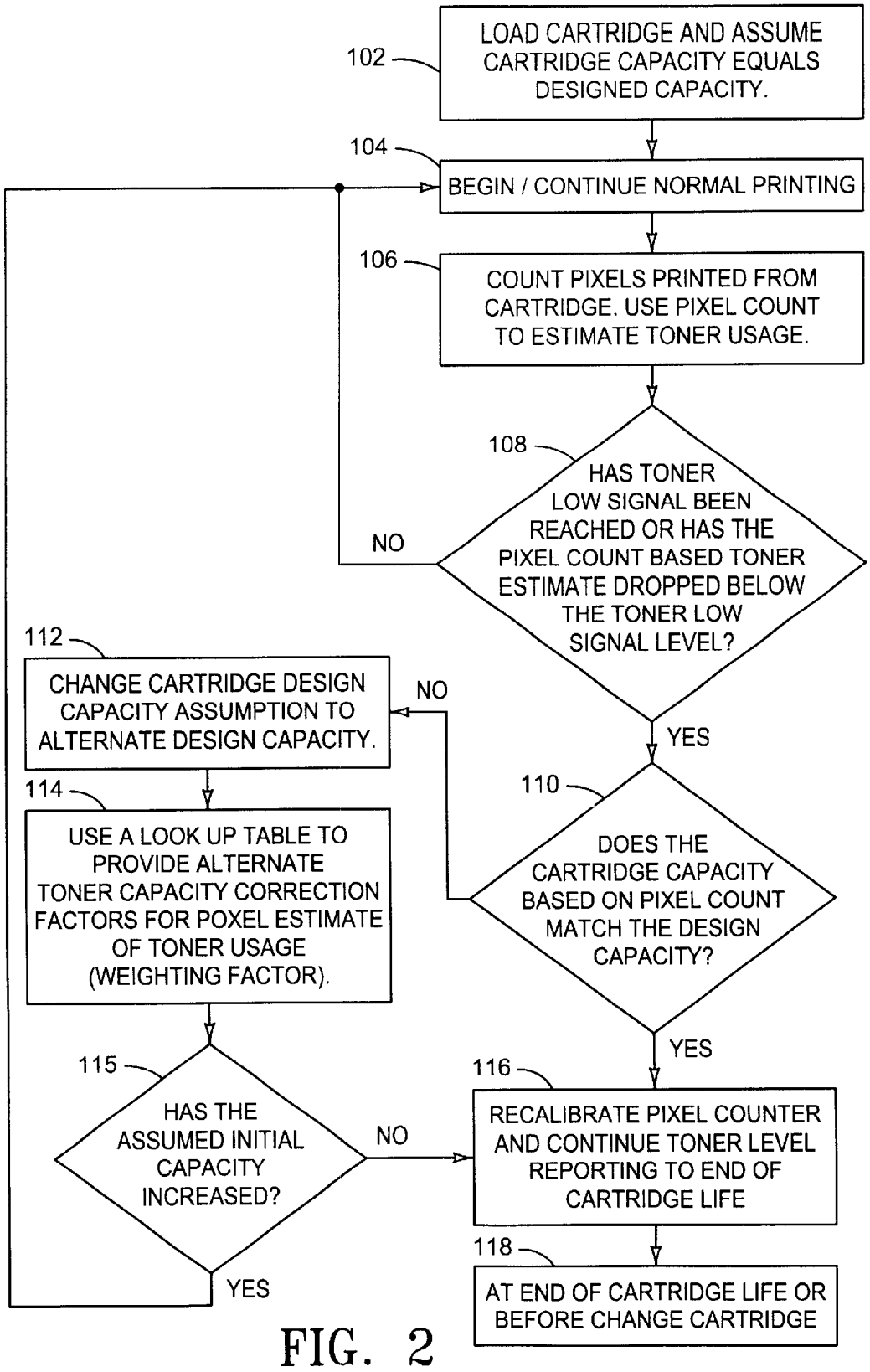
FIG. 2 is a flow chart illustrating the operation of the image forming apparatus in accordance with the present invention.

FIG. 2 is a flow chart illustrating the operation of the present invention. As shown in FIG. 2, a new toner cartridge 31 is loaded into the printer 10 (step 102). The printer 10 assumes that the capacity of the toner cartridge 31 is that of the recommended replacement model suggested to the user. Because the user may have selected an alternate toner cartridge having a capacity different than the recommended replacement model, the initial capacity assumption may be incorrect. Thus, for example, the recommended replacement model may have a capacity of 2000 pages, but the user may select an alternate toner cartridge with a capacity of 4000 pages.

In one embodiment, the printer 10 may prompt the user to identify the toner cartridge or the capacity of the toner cartridge that is being loaded into the printer. Nevertheless, the present invention may still advantageously be used to ensure that the information provided by the user is correct or in the case where the user fails to respond to the prompt.

The printer 10 begins normal printing (step 104) and counts the pixels printed via pixel counter 44 (step 106). The printer 10, via processor 36, estimates the amount of remaining toner in the toner cartridge based on the pixel count, e.g., the number of pixels printed is converted into an estimated amount of toner and the amount of toner is deducted from the assumed initial capacity of the toner cartridge 31. The printer 10 may report to the user the estimated toner remaining based on the pixel count.

The printer 10 continues normal printing (step 104) until a toner low signal has been received from toner sensor 30, or the toner estimate based on pixel counting has dropped below the predicted toner low signal level based on the initial capacity assumption and the toner low signal has not been received (step 108).

At some later time, when the toner low signal is received, or the toner estimate based on pixel count drops below predicted toner low signal level, processor 36 compares the estimated remaining toner based on pixel count with the predicted toner low signal level to determine if there is a match (step 110). If there is a match, the assumed initial capacity of the toner cartridge 31 is correct. If, however, there is no match, the assumed initial capacity of the toner cartridge 31 is incorrect and the correct capacity must be assigned to toner cartridge 31 (step 112).

The printer 10 can determine the actual toner capacity based on the difference between the estimated remaining toner based on pixel count and the predicted toner low signal level. Thus, for example, if the estimated remaining toner based on pixel count is greater than the actual level of toner when the toner level signal is provided, the actual toner capacity is smaller than the assumed initial capacity. Based on the difference, the processor 36 can determine the actual capacity of the toner cartridge. If, on the other hand, the estimated remaining toner based on pixel count is less than the predicted toner low signal level, i.e., the level at which the toner level signal should have been provided, but the toner level signal has not been provided, the actual toner capacity is greater than the assumed initial capacity. Thus, the printer 10 is able to identify the toner capacity based on the pixel count and the single level toner sensor signal.

The printer 10 uses the look-up table 46 to provide correction factors for the pixel estimate of toner usage, i.e., a weighting factor (step 114) so that printer 10 can provide an accurate estimate of the total toner remaining for the remainder of the toner cartridge life. Thus, for example, where the initial assumed cartridge capacity is 4000 pages and, based on pixel count, 2500 pages of toner capacity remain, i.e., an estimated 1500 pages have been printed, but the toner level signal indicates that 30 percent of the toner remains, the assumed cartridge capacity will be changed to the alternate capacity of 2000 pages in step 112. With the assumption that the cartridge capacity is 2000 pages, however, the estimated remaining toner based on pixel count is still incorrect. In other words, because 1500 pages are estimated to have been printed, there should be 500 pages of toner capacity remaining. The toner level signal, however, indicates that 600 pages remain, i.e., 30 percent of 2000. Thus, look-up table 46 is used in step 114 to provide a weighting factor to correct the pixel estimate of toner usage. The correction to the estimated remaining toner may be done over a period of time so the user does not see a dramatic change in estimated toner level.

If the initially assumed toner capacity is too low, the toner capacity will be changed to a greater capacity in step 112 without having received the toner level signal. Consequently, a weighting factor in step 114 cannot be provided because the actual remaining toner level is not yet known. Thus, if the assumed toner capacity increases (step 115), the process will flow back to step 104. The process continues using the new assumed toner capacity until the toner level signal occurs steps 108 and 110.

If the assumed toner capacity does not increase in step 115, or if the cartridge capacity based on pixel count matches the assumed capacity in step 110, the printer 10 continues reporting the toner level to the end of the toner cartridge 31 life (step 116). If recalibration of the pixel count has not occurred, i.e., in step 114, this will occur in step 116. Thus, for example, if the pixel count indicates that 28 percent of the toner remains, but the toner level signal indicates that 30 percent of the toner actually remains, i.e., the pixel counter is underestimating the toner level, the look-up table 46 will provide a weighting factor to correct for the underestimation. At the end of the toner cartridge life or before, the user is warned and prompted to change the toner cartridge 31 (step 118).

Figure 3:
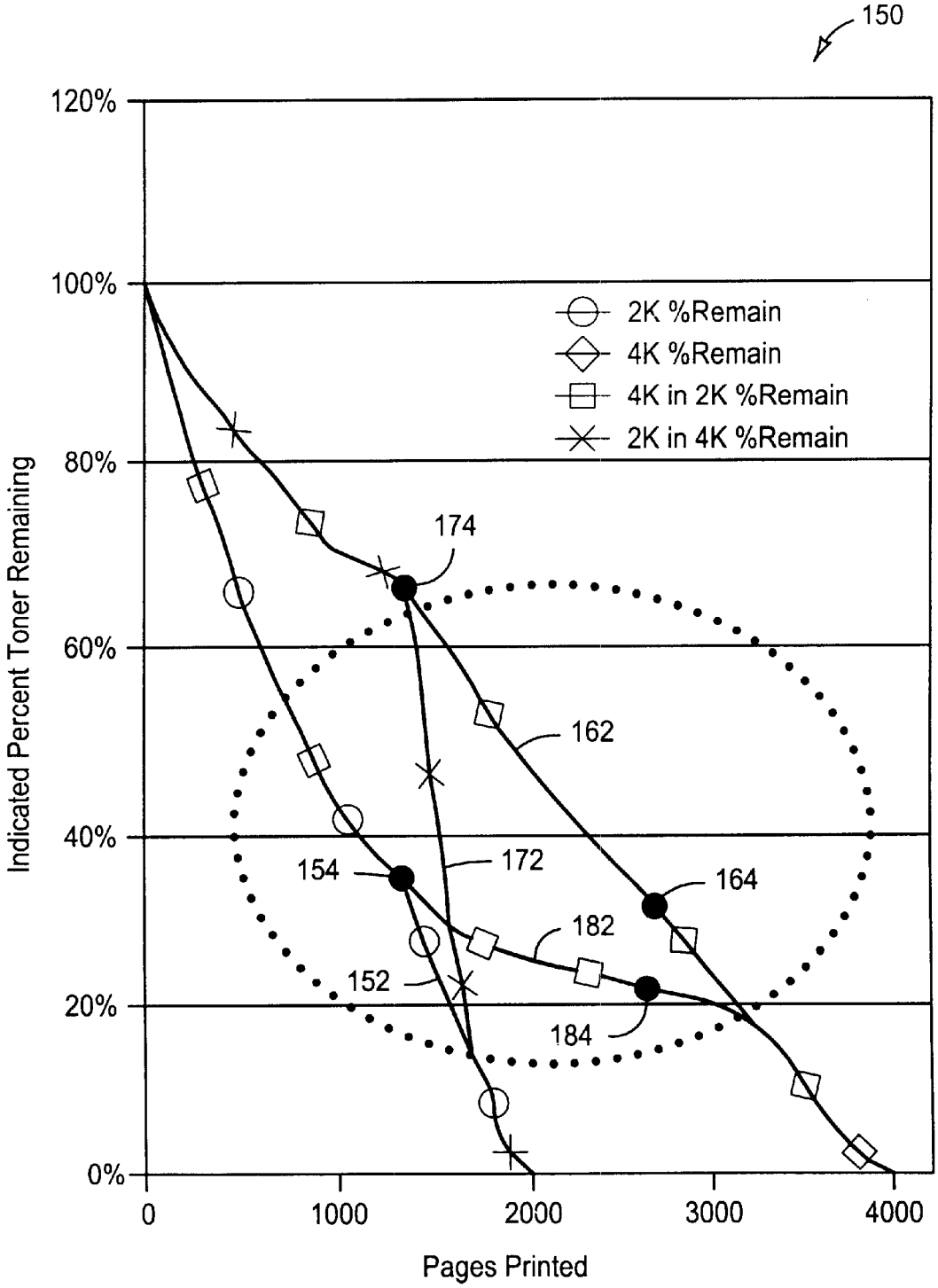
FIG. 3 is a graph illustrating the operation of the present invention.

FIG. 3 is a graph 150 illustrating the operation of the present invention, where the X axis represents the cartridge capacity in terms of the number of pages printed and the Y axis represents the indicated percent of toner remaining in the toner cartridge. For the sake of simplicity, graph 150 illustrates only two toner cartridge capacities, i.e., 2000 pages or 4000 pages. It should be understood, however, that the present invention may be used with additional toner cartridge capacities if desired.

With two toner cartridge capacities, there are four possible scenarios. In one scenario, a 2000 page toner cartridge is loaded into printer 10 and printer 10 assumes that a 2000 page toner cartridge has been installed, which is illustrated in graph 150 by line 152, which is intersected by circles. The pixel counter 44 in printer 10 counts the pixels printed. At some time during the printing, e.g., when 30 percent of the toner remains, illustrated by point 154, the toner sensor 30 will provide a toner low signal. The estimated toner level based on pixel counting is compared to the actual toner level based on the toner sensor 30 to determine the type of toner cartridge installed. Because in this scenario the estimated toner level approximately matches the actual toner level, i.e., 30 percent, the printer 10 continues to assume that the toner capacity is 2000 pages. The printer 10 then provides minimal correction, via look-up table 46, to the pixel counting estimate of the amount of remaining toner, based on any discrepancy between the toner level based on the toner level signal and the pixel count, and the printer 10 continues to report the toner level based on the assumed 2000 page capacity of the toner cartridge.

In a similar scenario, a 4000 page toner cartridge is loaded into printer 10 and the printer assumes that a 4000 page toner cartridge has been installed, which is illustrated by line 162, which is intersected by triangles. As above, the toner sensor 30 provides a toner low signal when, e.g., 30 percent of the toner remains at point 164. Because the estimated toner level based on pixel counting approximately matches the actual toner level based on toner sensor 30, the printer 10 continues to assume that the toner capacity is 4000 pages. The printer 10 then provides minimal correction, via look-up table 46, to the pixel counting estimate of the amount of remaining toner, based on any discrepancy between the toner level based on the toner level signal and the pixel count, and the printer 10 continues to report the toner level based on the assumed 4000 page capacity of the toner cartridge.

In another scenario, a 2000 page toner cartridge is loaded into printer 10, but the printer assumes that a 4000 page toner cartridge is installed, which is illustrated by line 172, which is intersected by "x"s. As shown in FIG. 3, the printer will initially estimate the remaining toner based on the assumed initial capacity, i.e., 4000 pages. The estimated use of toner is linear following the 4000 page model, i.e., line 172 overlies line 162, until a toner low signal is produced by toner sensor 30 at point 174. Toner sensor 30 provides a toner low signal when approximately 30 percent of the toner remains, i.e., when approximately 1400 pages have been printed. The printer 10 compares the estimated toner level based on pixel counting with the known level of toner based on the toner low signal. The significant difference between estimated toner level based on pixel count, approximately 65 percent, and actual toner level, approximately 30 percent, enables the printer 10 to correctly identify the toner cartridges as having a 2000 page capacity. The assumed capacity of the toner cartridge is thus changed to 2000 pages. Moreover, any error in the pixel count may be corrected with a weighting factor from look-up table 46 to provide a reliable estimate of toner level by pixel counting for the remainder of the life of the toner cartridge, shown as an increased slope of line 172 after point 174. Thus, for example, where the toner level signal indicates that 30 percent of the toner remains, but the pixel count based on the new 2000 page assumption indicates that, e.g., 32 percent of the toner remains, a weighting factor to correct the 2 percent discrepancy is provided by look-up table 46.

In the last scenario, a 4000 page toner cartridge is loaded into the printer, but the printer assumes that a 2000 page toner cartridge is installed, which is illustrated by line 182, which is intersected by squares. As shown in FIG. 3, the estimated use of toner is linear following the assumed 2000 page model and, thus, line 182 overlies line 152 until the estimated remaining toner based on pixel count indicates that 30 percent of the toner remains at point 154. If the estimated remaining toner based on pixel count reaches below the predicted toner low signal level, i.e., 30 percent of the assumed 2000 page toner cartridge, without toner sensor 30 producing a toner low signal, printer 10 can change the assumed print cartridge capacity to 4000 pages. Of course, a safety margin, e.g., of 5 percent, may be used to ensure that assumed cartridge capacity is not adjusted prematurely. Thus, the printer selects an alternate capacity, i.e., 4000 pages, and uses the new assumption to look up a weighting factor from look-up table 46 to provide a reliable estimate of toner level by pixel counting for the remainder of the life of the toner cartridge, shown as a decreased slope of line 182 after point 154.

If desired, when toner sensor 30 provides a toner low signal at point 184, indicating that 30 percent of the 4000 page capacity remains, printer 10 can again recalibrate the pixel counter and continue toner level reporting. Alternatively, once printer 10 identifies the toner cartridge as having a 4000 page capacity, the printer 10 can ignore the toner low signal because the toner capacity has already been identified.

Where the present invention is used to determine the ink capacity of an ink cartridge, e.g., cartridge 31, the estimated remaining ink is determined by counting printed elements, i.e., ink drops, by counter 44. The actual ink level is determined by an ink level sensor, e.g., sensor 30. The process of determining the ink capacity of the ink cartridge is substantially similar to that shown in FIGS. 2 and 3.

It should be understood that the foregoing description is only illustrative of the invention. Various alternatives and modifications can be devised by those skilled in the art without departing from the invention. For instance, the invention has been described based on two alternate toner capacities, i.e., 2000 page and 4000 page. It should be understood, however, that the present invention may be used to identify toner cartridges having more than two alternate toner capacities. The present invention may be implemented by providing a toner level signal at any level and is not limited to 20 to 40 percent. However, if the toner level signal is provided too early, e.g., when 90 percent of the toner remains, the difference between the estimated remaining toner based on pixel count and the known level of toner based on the toner level signal may be inadequate to accurately identify the toner capacity. Moreover, it should be understood that the present invention may be used in any appropriate electrophotographic image-forming device including, but not limited to laser printers, electrophotographic copy machines and facsimile machines. Further, the type of toner sensor and method of pixel counting may vary. The correction to the estimated remaining toner may be linear, using a weighting factor as shown in FIG. 3, or may be non-linear. Accordingly, the present invention is intended to embrace all such alternatives, modifications and variances that fall within the scope of the appended claims.

What is claimed is:

1. A method of identifying a printing medium capacity of a printing medium cartridge, said method comprising:

assuming a printing medium capacity of said printing medium cartridge;

estimating a printing medium level based on counting printed elements and the assumed printing medium capacity;

providing a printing medium level signal indicating when a printing medium in said printing medium cartridge is at a known level;

determining the printing medium capacity by comparing the estimated printing medium level based on counting printed elements with the known level of printing medium; and assigning an actual printing medium capacity of said printing medium cartridge, wherein said actual printing medium capacity is different than said assumed printing medium capacity if the estimated printing medium level is different than the known level of printing medium, and wherein said actual printing medium capacity is said assumed printing medium capacity if the estimated printing medium level is approximately the same as the known level of printing medium when said printing medium is level signed is provided.

2. The method of claim 1, wherein said printing medium is toner and wherein said printed elements are pixels.

3. The method of claim 1, wherein said printing medium is ink and wherein said printed elements are ink dots.

4. The method of claim 1, wherein determining the printing medium capacity is performed before providing a printing medium level signal, wherein said actual printing medium capacity is different than said assumed printing medium capacity if the estimated printing medium level is less than the known level of printing medium and no printing medium level signal is provided.

5. The method of claim 1, wherein assigning the actual printing medium capacity comprises:

assigning as the actual printing medium capacity a smaller capacity than the assumed printing medium capacity if said estimated printing medium level is greater than the known level of printing medium when said printing medium level signal is provided; and assigning as the actual printing medium capacity a larger capacity than the assumed printing medium capacity if said estimated printing medium level is less than the known level of printing medium before said printing medium level signal is provided.

6. The method of claim 1, further comprising continuing to estimate the printing medium level based on counting printed elements and the actual printing medium capacity.

7. The method of claim 6, further comprising recalibrating the estimate of the printing medium level based on pixel counting using said actual printing medium capacity.

8. The method of claim 1, wherein said known level of printing medium is approximately 20 percent to 40 percent of the printing medium remaining in said printing medium cartridge.

9. A system for identifying a printing medium capacity of a printing medium cartridge in an image forming device, said printing medium capacity being unknown when said printing medium cartridge is loaded into said image forming device, said system comprising:

a printing medium sensor having a printing medium sensing element positioned to detect when printing medium in said printing medium cartridge falls below a single known level;

a printed element counter configured to count printed elements when said image forming device forms images; and a processor coupled to receive signals from said printing medium sensor and, said printed element counter, said processor configured to estimate the remaining printing medium in said printing medium cartridge based on signals from said printed element counter, said processor configured to identify the printing medium capacity of said printing medium cartridge based on a comparison between said estimated remaining printing medium and said known level.

10. The system of claim 9, wherein said printing medium sensor is at least one of an optical sensor and a fuse sensor.

11. The system of claim 9, wherein said printed element counter is configured to count pixels in a binary data stream.

12. The system of claim 9, wherein said printed element counter is configured to count pixels in a laser pulse modulation stream.

13. The system of claim 9, wherein said image forming device is an electrophotographic printing device, said printing medium is toner, and said printed element counter is a pixel counter.

14. The system of claim 9, wherein said image forming device is an ink jet printing device, said printing medium is ink, and said printed element counter is a drop counter.

15. The system of claim 9, further comprising:

a look-up table, wherein said processor is configured to use the identified printing medium capacity and said look-up table to recalibrate the estimation of remaining printing medium in said printing medium cartridge based on signals from said printed element counter.

16. A method of determining a printing medium capacity of a printing medium cartridge, said method comprising:

assuming the printing medium capacity of said printing medium cartridge loaded in an image forming device, counting elements printed while forming images;

estimating remaining printing medium in said printing medium cartridge based on counted elements printed;

providing a printing medium level signal indicating when the remaining printing medium in said printing medium cartridge reaches a known level;

comparing the estimated remaining printing medium based on counted elements with the known level; and changing the assumed printing medium capacity if said estimated remaining printing medium is different than said known level of remaining printing medium.

17. The method of claim 16, wherein said comparing the estimated remaining printing medium based on counted elements with the known level occurs after said printing medium level signal is provided.

18. The method of claim 16, wherein said comparing the estimated remaining printing medium based on counted elements with the known level occurs when said estimated remaining printing medium is lower than said known level and said printing medium level signal has not yet been provided.

19. The method of claim 16, further comprising not changing the assumed printing medium capacity if said estimated remaining printing medium is approximately the same as said known level.

20. The method of claim 16, further comprising:

providing a weighting factor for said estimate of remaining printing medium based on the difference between said estimated remaining printing medium based on counted elements and the known level; and estimating remaining printing medium in said printing medium cartridge based on counted elements printed and said weighting factor.

21. The method of claim 16, wherein said printing medium is toner and wherein said counted elements are pixels.

22. The method of claim 16, wherein said printing medium is ink and wherein said counted elements are ink drops.

* * * * *

UNITED STATES PATENT AND TRADEMARK OFFICE

CERTIFICATE OF CORRECTION

PATENT NO. : 6,456,802 B1
DATED : September 24, 2002
INVENTOR(S) : Phillips

It is certified that error appears in the above-identified patent and that said Letters Patent is hereby corrected as shown below:

Column 8,
Line 65, between “medium” and “level”, delete “is”; and
Line 65, delete “signed” and insert therefor -- signal --.

Column 9,
Line 46, delete “and,” and insert therefor -- and --.

Signed and Sealed this

Thirtieth Day of December, 2003

JAMES E. ROGAN
*Director of the United States Patent and Trademark Office*